US005190411A

United States Patent [19]

Huete et al.

[11] Patent Number: 5,190,411

[45] Date of Patent: Mar. 2, 1993

[54] TENSION LEG WELL JACKET

[75] Inventors: David A. Huete, Spring; Lee K. Brasted, Kingwood; George Rodenbush, Houston, all of Tex.

[73] Assignee: Shell Oil Company, Houston, Tex.

[21] Appl. No.: 919,631

[22] Filed: Jul. 24, 1992

Related U.S. Application Data

[63] Continuation of Ser. No. 624,842, Dec. 10, 1990, abandoned.

[51] Int. Cl.[5] ..... E02B 17/00

[52] U.S. Cl. ..... 405/223.1; 405/203; 405/224.2

[58] Field of Search ..... 405/195.1, 202, 203, 405/223.1, 224, 224.2; 114/264, 265; 166/350, 353, 359, 366, 367; 175/7

[56] References Cited

U.S. PATENT DOCUMENTS

| | | | |
|---|---|---|---|
| 3,504,740 | 4/1970 | Manning | 166/366 X |
| 3,717,002 | 2/1973 | O'Brien et al. | 405/DIG. 11 X |
| 3,727,414 | 4/1973 | Davies . | |
| 4,156,577 | 5/1979 | McMakin | 405/196 |
| 4,492,270 | 1/1985 | Horton | 166/358 |
| 4,633,953 | 1/1987 | LeBoeuf et al. | 166/358 |
| 4,643,614 | 2/1987 | Laursen | 405/169 |
| 4,721,412 | 1/1988 | King et al. | 405/195 |
| 4,735,526 | 5/1988 | Kawagoe et al. | 405/196 |
| 4,740,109 | 4/1988 | Horton | 405/224 |
| 4,754,817 | 7/1988 | Goldsmith | 175/7 |
| 4,784,529 | 11/1988 | Hunter | 405/224 X |
| 4,893,965 | 1/1990 | Jordan | 405/202 |
| 4,907,657 | 3/1990 | Cox | 175/9 |
| 4,907,912 | 3/1990 | Smith | 405/208 |
| 4,913,238 | 4/1990 | Danazcko et al. | 166/350 |
| 4,934,871 | 6/1990 | Kazokas | 405/224 |
| 4,966,495 | 10/1990 | Goldman | 405/195 |
| 4,972,907 | 11/1990 | Sellars, Jr. | 166/153 |
| 4,973,198 | 11/1990 | Cox | 405/201 |
| 4,995,762 | 2/1991 | Goldman | 405/195 |

FOREIGN PATENT DOCUMENTS

WO85/01927 5/1985 PCT Int'l Appl. .

OTHER PUBLICATIONS

"Semisubmersible Drilling Tender Unit" by James E. Chitwood and Alan C. McClure, SPE Drilling Engineering, Jun. 1987.

"Conoco Readies Jolliet TLWP for Nov. 1 Startup", Ocean Industry pp. 17-21, Oct., 1989.

"Field Experience Proves Semisubmersible Drilling Tender Concept", by H. I. Knecht and M. E. Nagel, Offshore, Sep. 1990, pp. 56-57.

"Minifloater: A Deepwater Production Alternative", Kerckhoff et al, Ocean Industry, Sep. 1990, pp. 147-152.

*Primary Examiner*—David H. Corbin

*Attorney, Agent, or Firm*—Mark A. Smith

[57] ABSTRACT

A tension leg well jacket ("TLWJ") is disclosed which is configured to receive well operations support from an offshore drilling vessel docked thereto and to receive the production riser in transfer operations from the vessel to the TLWJ. This permits a minimal platform suitable for supporting production risers which is particularly useful in deep water applications.

25 Claims, 11 Drawing Sheets

40
42
40A
48
30
60A
10
26
24
12
22
50
50
60
20
54
52
46
16
28
44
44A
14
44

FIG. 2
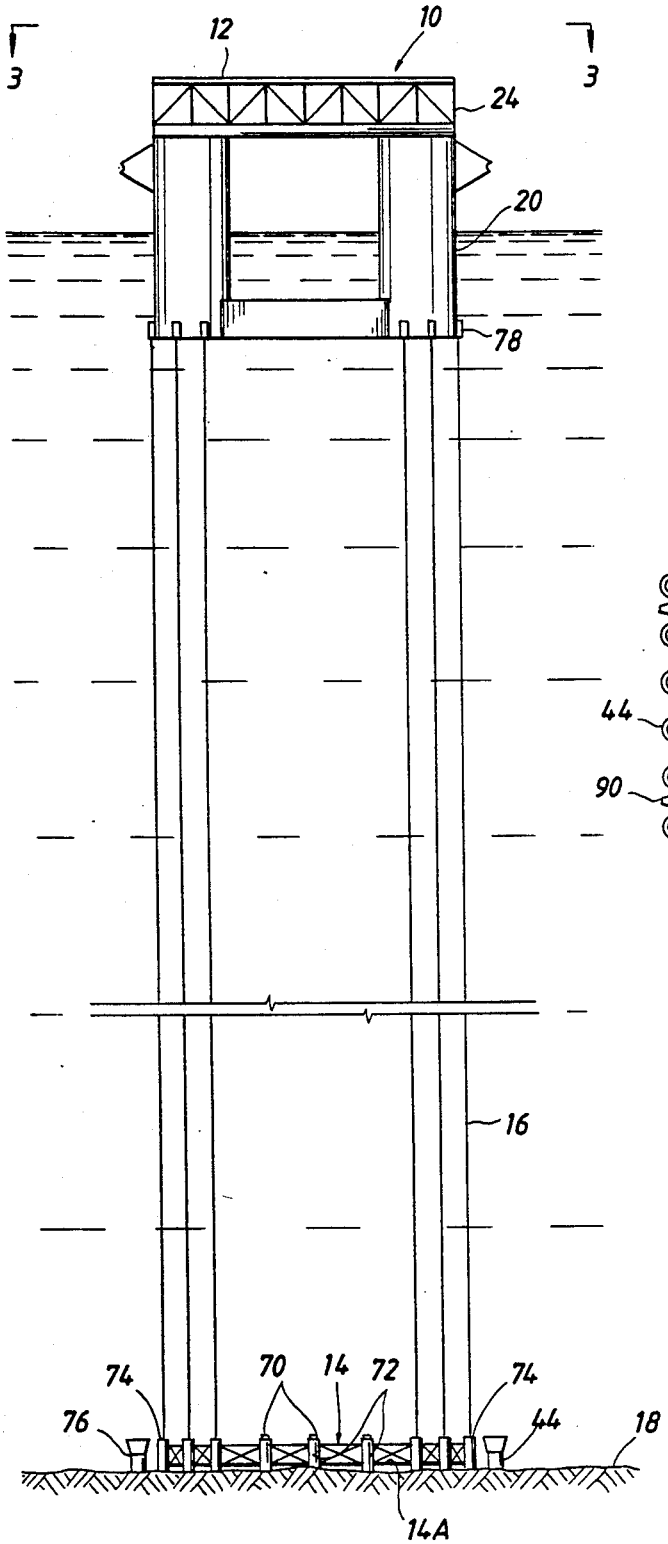
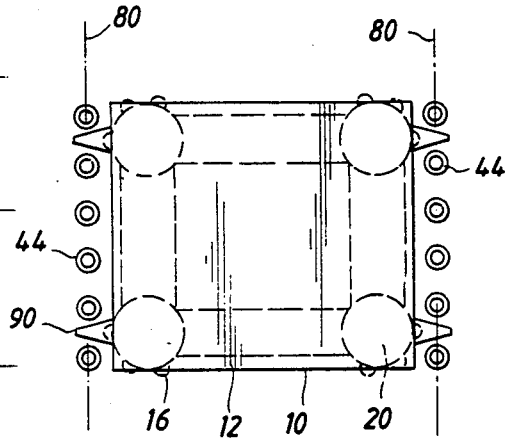
FIG. 3

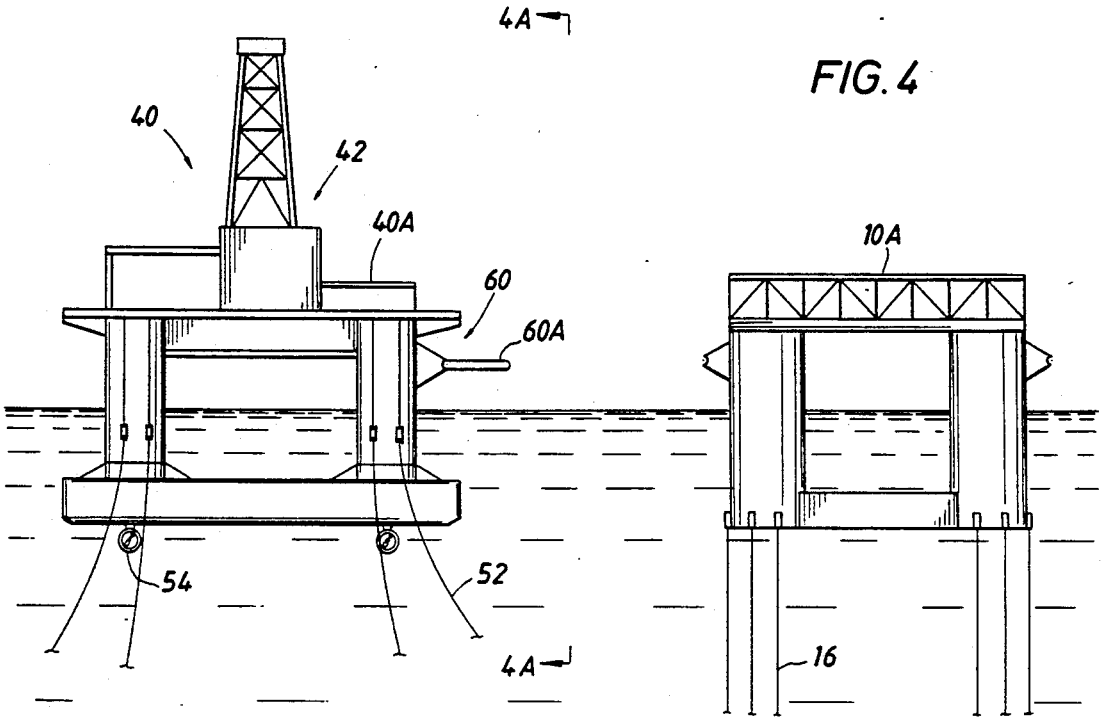
FIG. 4
FIG. 4A
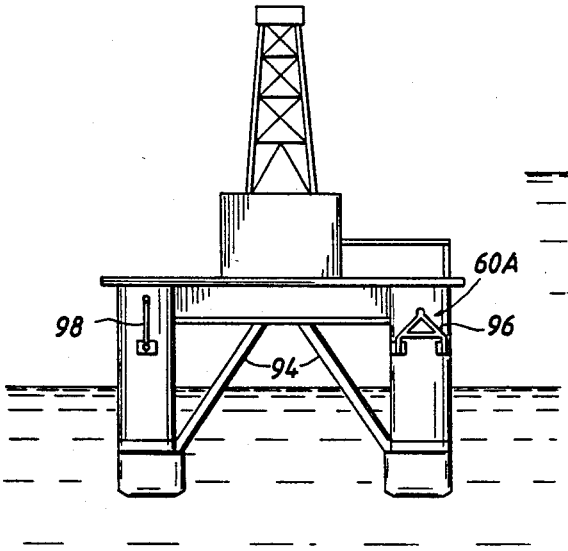
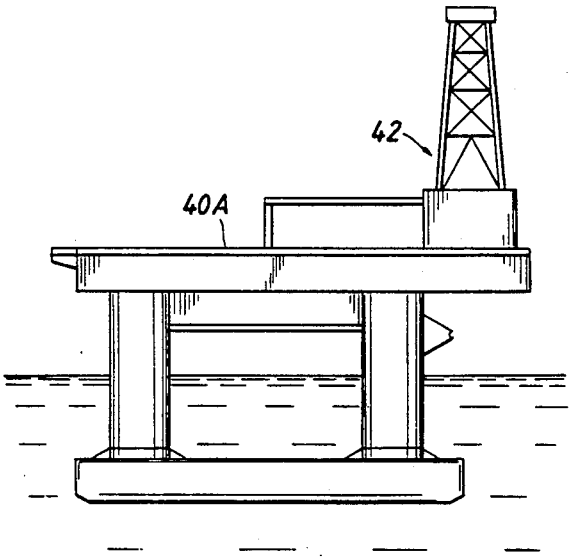
FIG. 4B 52
40A
96
90A
10
90
60
98
60
52

80
52
80
40A
96
90A
10
90
60
60
98
90B
10
90
40
52

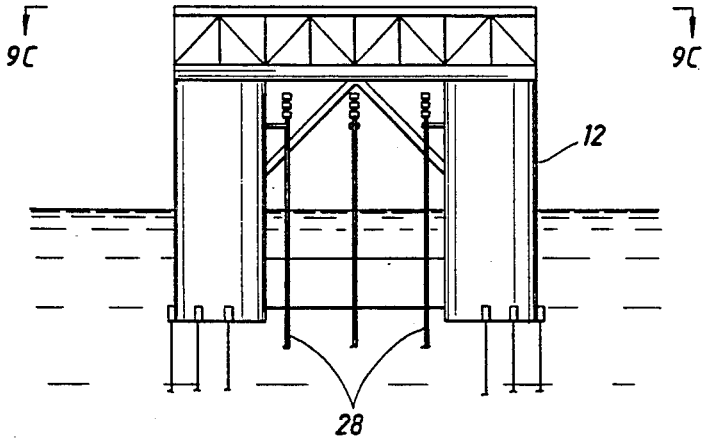
FIG.9B
FIG.9C
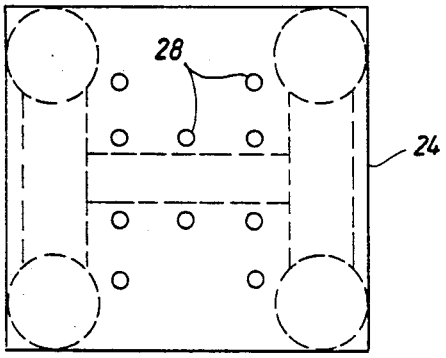
FIG.9D
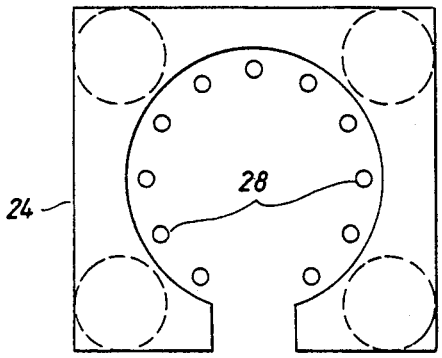
FIG.10
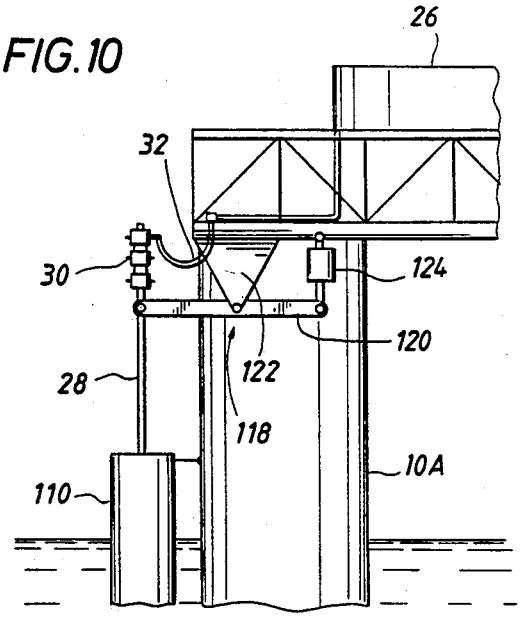
FIG.10A
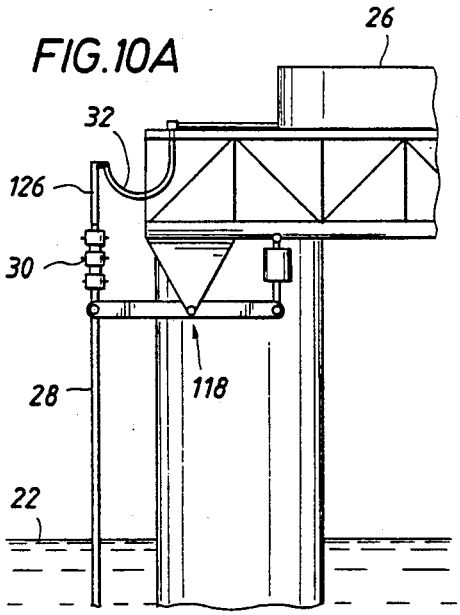

TENSION LEG WELL JACKET

This is a continuation of application Ser. No. 624,842, filed Dec. 10, 1990, now abandoned.

BACKGROUND OF THE INVENTION

The present invention relates to a method and apparatus for supporting production risers for the development of an offshore reservoir. More particularly, the present invention relates to a tension leg platform (TLP) for supporting surface accessible wellheads.

Traditional bottom-founded platforms having a fixed or rigid tower structure have been taken to their logical depth limits in the development of offshore oil and gas reserves. Economic considerations suggest that alternatives to this traditional technology be ordinarily used in deep water. Further, even the most promising reservoirs are difficult to economically exploit in this manner at any depth greater than about 1200 feet in the Gulf of Mexico and often less in other areas.

One alternative to fixed towers is to drill from facilities provided on surface vessels and to complete the wells at the ocean floor with subsea completions. Gathering lines connect the subsea wells to facilities usually located at the surface, either in the immediate vicinity or in a remote location. However, subsea wells are relatively inaccessible at the ocean floor and this fundamental problem is exacerbated by the rigors of the maintenance-intensive subsea environment. The result is complex, costly maintenance operations.

Alternatively, deepwater wells can be provided with surface completions on specialized structures more suitable for deepwater applications. One such design is the tension leg platform. Broadly, this design concept employs a floating superstructure secured to the ocean floor through tendons or tethers which are tensioned to draw the superstructure down below its free-floating draft. Such structures can provide drilling and production facilities in deep water at costs less than those of traditional fixed platforms. Nevertheless, the high cost of the traditional practice of these structures requires a high concentration of wells in order to be economically feasible.

The cost of deepwater platforms further increases with the range of well operations to be conducted from the platform. Depending on the well operations, this can substantially increase the load on the platform, thereby requiring a substantially larger structure.

For instance, a full capability drilling rig can be deployed which will allow primary drilling from the tension leg platform ("TLP"). This requires a large structure which must support a large number of wells. Many hydrocarbon reservoirs cannot effectively utilize, and therefore justify, such a number of wells. Other reservoirs can justify the number of wells, but only if extended reach drilling techniques are used to drain relatively remote areas of the reservoir from the facilities provided on the platform. This extended reach can be accomplished with the current directional and horizontal drilling techniques, but only by substantially increasing the drilling cost for the wells so extended. Further, primary drilling operations to develop a dispersed reservoir with extended reach techniques from a central location can spread the drilling operations over many years. Subsequent well workover operations may tie the drilling rig to the platform many years thereafter even though primary drilling is complete. Both aspects represent economic inefficiencies. In the first instance, drilling such extended reach wells, one well at a time, delays production, thereby adversely affecting the rate of return of the substantial capital expenditures necessary to provide such a deepwater structure. Further, after the wells have been drilled, the rig represents a very substantial asset which cannot otherwise be efficiently used and has similarly permanently committed the prospect to the larger structure, thereby affecting the cost of the platform as well.

Alternatively, the wells can be predrilled from a drill ship or other floating facility, killed or otherwise secured, and completed from a scaled-down "completion" rig carried on a production platform such as a tension leg well platform (TLWP) installed at the site later. This reduces the load on the permanent facilities and therefore permits a somewhat smaller platform, but prevents production from any well until all the wells have been drilled and thereby substantially defers revenue from the development. Further, this scheme does not allow the flexibility to permit additional or replacement drilling once the platform has been installed.

Efficient development of deepwater hydrocarbon reserves must overcome these deficiencies and provide for developing the reservoirs with lower capital outlays, faster return on investment, more efficient reservoir management for larger reservoirs, and enhanced profitability for reservoirs that are otherwise marginal. The present application is for a platform design which facilitates methods disclosed in copending applications which, together, provide the benefits referenced above.

SUMMARY OF THE INVENTION

It is an object of the present invention to economically provide a platform to support surface accessible completions for offshore oil and gas wells, especially in deep water.

It is a further object of the present invention to provide a deepwater platform which will facilitate the use of well operation facilities temporarily supplied by an offshore drilling vessel.

Another object of the present invention is a more economical platform facilitating a more efficent distribution of surface-accessible wells over a deepwater reservoir with a plurality of platforms spaced over the reservoir and connected by pipelines.

Finally, it is an object of the present invention to provide a minimal platform supporting surface well completions which also affords an opportunity for additional development drilling as well as maintenance work on existing wells with temporarily deployed offshore drilling vessels.

Toward the fulfillment of these and other objects, a tension leg well jacket ("TLWJ") is provided which comprises a foundation secured to the ocean floor, a superstructure having a buoyant hull, tendons connecting the foundation and the superstructure, means for docking the superstructure to an offshore drilling vessel and a laterally accessible riser support mounted on the superstructure. Further, the present invention provides a method of providing support to an offshore riser comprising installing a tension leg well jacket at a selected site, laterally transferring the riser from an offshore drilling vessel docked to the tension leg well jacket and securing the riser in the riser support.

The present invention is a TLWJ suitable for deepwater use and providing for surface accessible completions without being scaled to support the weight of a major drilling rig. Thus, the TLWJ utilizes drilling facilities temporarily supplied by an offshore drilling vessel which can relocate those facilities when no longer needed at the platform. The resulting platform is inexpensive enough to provide in multiple copies for a major reservoir and to economically deploy singularly for more marginal prospects.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 2 is a side elevation view of a TLWJ in accordance with the present invention;

FIG. 3 is a top plan view of the TLWJ of FIG. 2 taken along line 3—3 of FIG. 2;

FIG. 4 is a side elevation view of a semisubmersible vessel approaching a TLWJ constructed in accordance with the present invention;

FIG. 4A is a front elevation view of the semisubmersible vessel of FIG. 4 taken along the line 4A—4A;

FIG. 4B is a side elevation view of an alternate embodiment of a semisubmersible vessel in which the drilling facilities are positioned on a cantilevered section of the deck;

FIG. 9B is a side elevation view of an alternate embodiment of a TLWJ in accordance with the present invention having laterally accessible means for receiving production risers;

FIG. 9C is a top plan view of the TLWJ of FIG. 9B taken along line 9C—9C in FIG. 9B;

FIG. 9D is an overhead plan view of an alternate embodiment of a TLWJ in accordance with the present invention;

FIG. 10 is a side elevation view of a production riser being secured to a TLWJ constructed in accordance with the present invention;

FIG. 10A is a side elevation view of a production riser being brought into communication with facilities supported by the TLWJ constructed in accordance with the present invention;

DETAILED DESCRIPTION OF PREFERRED EMBODIMENTS

Figure 1:
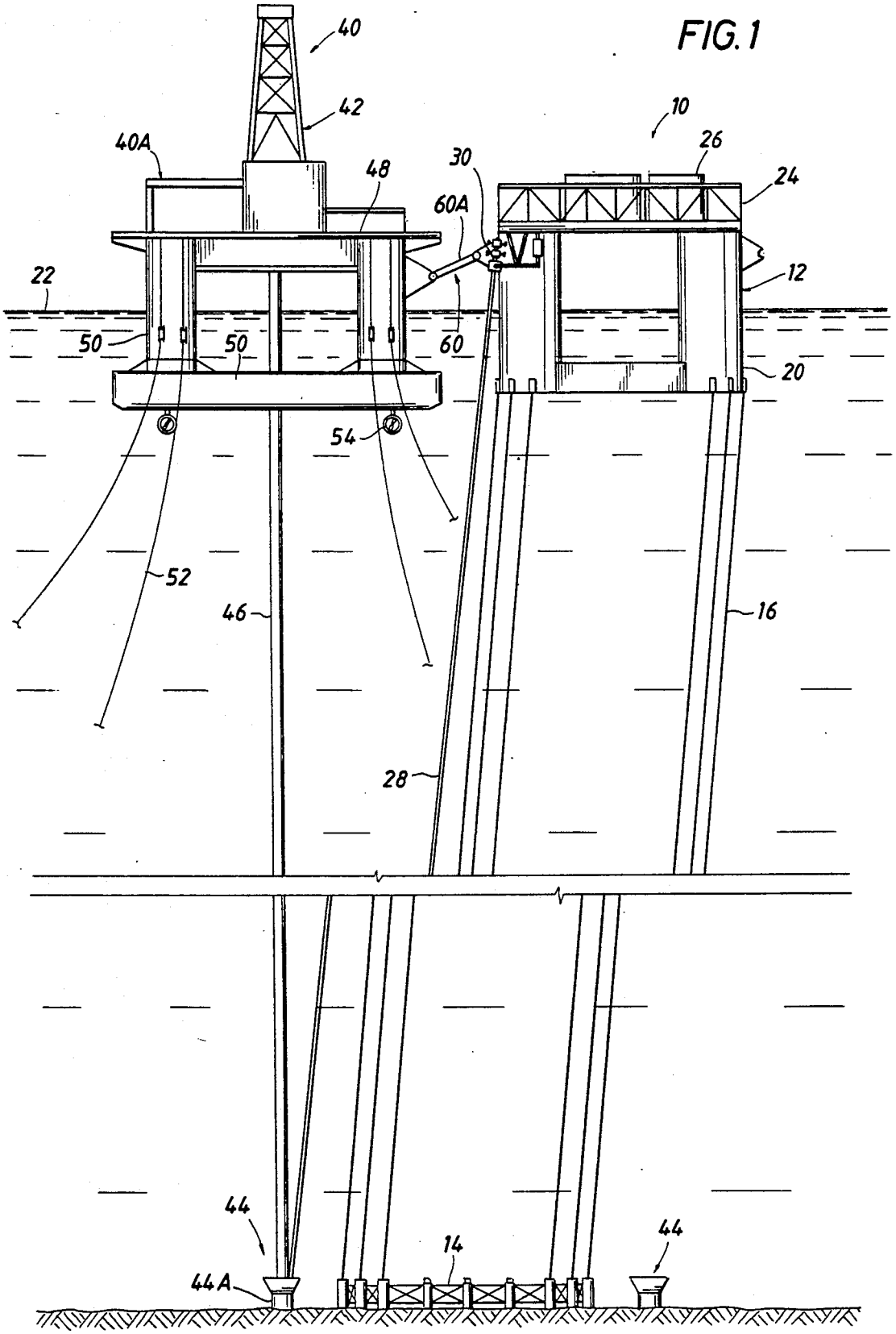
FIG. 1 is a side elevation view of a preferred embodiment of a TLWJ constructed in accordance with the present invention in which an adjacent semisubmersible vessel is conducting drilling operations.

FIG. 1 is a side elevation view of a tension leg well jacket ("TLWJ") 10 constructed in accordance with the present invention which is docked to an offshore drilling vessel 40, here a semisubmersible vessel 40A. TLWJ 10 which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26. A production riser 28 of a previously drilled well is supported by TLWJ 10 with the valve assembly of the surface completion or Christmas tree 30 supported above the ocean's surface. TLWJ 10 interfaces with offshore drilling vessel 40 through a restraining system or docking elements 60, here provided by a means 60A for docking the semisubmersible vessel to the tension leg well jacket.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46.

Figure 1A:
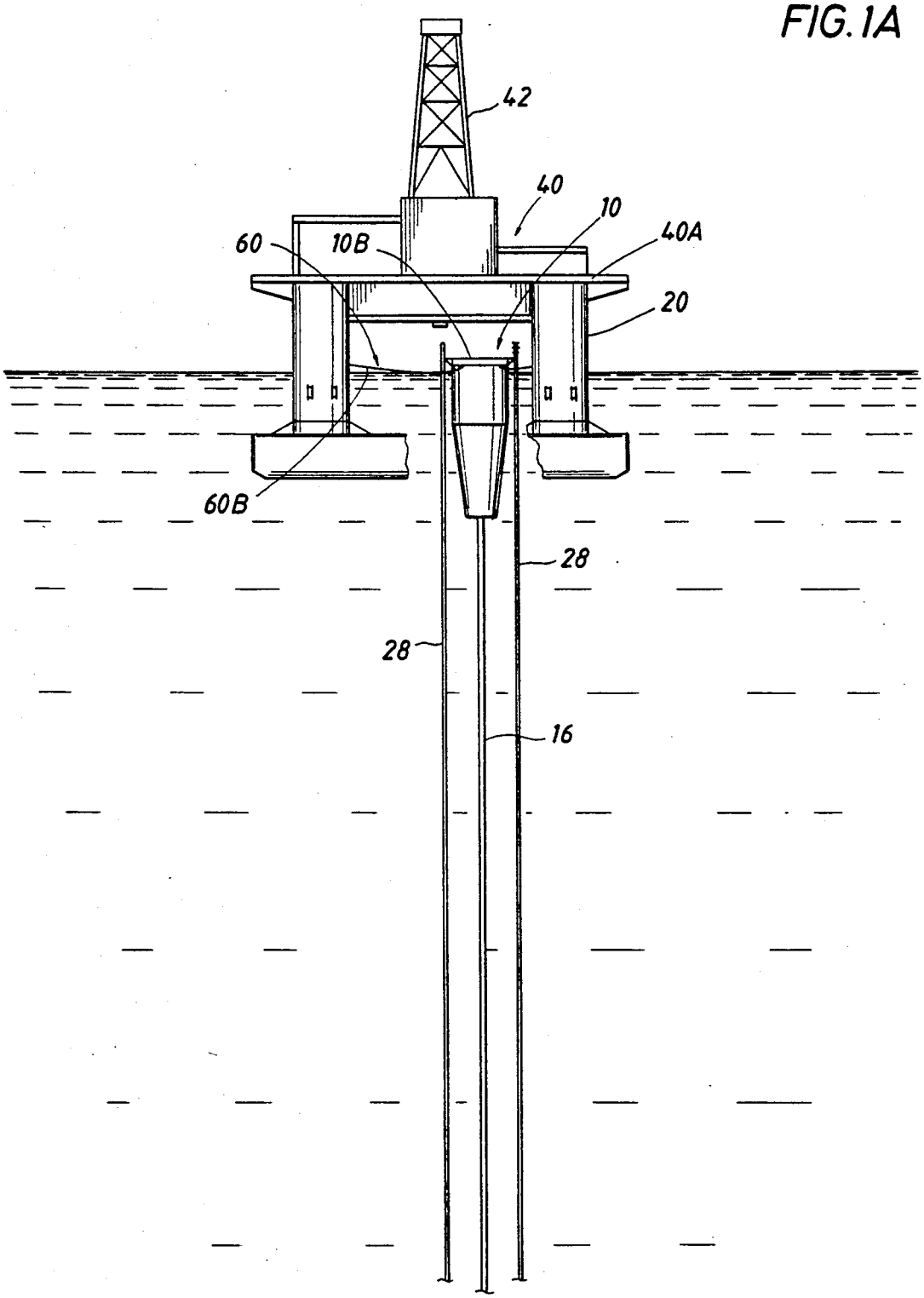
FIG. 1A is a side elevation view of an alternate embodiment of the present invention in which a semisubmersible vessel is conducting drilling operations over a monopod TLWJ.

FIG. 1A discloses an alternate embodiment of the present invention in which TLWJ 10 is a single column "monopod" 10B installed to the ocean floor with one or more tendons 16 and offshore drilling vessel 40 is a semisubmersible vessel 40A configured to ride over the installed monopod. The monopod is held in position with respect to the semisubmersible vessel by restraining system 60 or docking elements, here a set of guylines 60B. However, drilling operations are conducted substantially in place through a drilling riser supported by the semisubmersible vessel. After completion of drilling operations, the drilling riser is replaced with a production riser 28 which, in the preferred practice, is secured to the monopod before completion operations. In FIG. 1A, the semisubmersible vessel is positioned with derrick 42 directly over the production riser through which completion operations will be conducted. A previously drilled and completed well is illustrated with another production riser 28 also supported by monopod 10B. The monopod structure could alternatively be any structure small enough to fit inside the semisubmersible vessel's lower hull components which otherwise practices this invention.

FIGS. 2 and 3 illustrate a tension leg well jacket ("TLWJ") 10 which comprises a minimal TLP without drilling capabilities, and, at most, modest workover capabilities. The TLWJ is designed to exteriorly receive and secure production risers passed from the offshore drilling vessel (not shown here). FIG. 2 is a side elevation view of the TLWJ and FIG. 3 is an overhead view. These figures illustrate the same TLWJ pictured during drilling operations in FIG. 1.

Installation of TLWJ 10 begins by placing foundation 14, here supplied by unitary template 14A. The foundation is then secured to ocean floor 18. In the illustration, a plurality of piles 70 are driven into the ocean floor through pile sleeves 72 of the foundation and the piles are then secured to the pile sleeves with grouting or swaging operations. Other well known means for anchoring the foundation to the ocean floor may also be suitable. The foundation provides a means 74 for connecting tendons 16 and may include well guides 76 which are placed at well sites 44 adjacent the foundation. In the illustration, the well guides are placed independently and are not connected to the template. In some instances it is desirable to predrill some of the wells.

Superstructure 12 comprising buoyant hull 20 and deck 24 is towed to location and ballasted down. Typically, the buoyant hull will have vertical columns connected by horizontal pontoons. A framework also connects the columns and supports the deck. Tendons 16 are installed between means 74 for connecting the tendons to the foundation and means 78 for connecting the tendons 16 to floating superstructure 12. The tendons are initially tensioned during installation and deballasting of buoyant hull 20 further tensions the tendons to provide additional excess buoyancy to the TLWJ as necessary to produce the desired behavior under all loading conditions.

Desired well sites 44 are aligned in well lines 80 adjacent TLWJ 10 as best depicted in FIG. 3. The illustrated well pattern allows approach to the TLWJ from two sides without the danger of collision with the production risers (not shown) which will be in place on the periphery of the TLWJ. However, other deck configurations for the TLWJ and well pattern may be used without departing from the scope of the invention. Further, screens or other provisions can be deployed from the TLWJ to protect the production risers from boat traffic and floating debris.

Provisions are discussed below which facilitate laterally receiving and securing production risers transferred from an offshore drilling vessel. Another feature of the illustrated TLWJ is a plurality of docking supports 90, the purpose and function of which will become apparent in the discussion of the docking procedures illustrated in FIGS. 5 and 6.

FIG. 4 illustaates deployment of offshore drilling vessel 40 adjacent installed TLWJ 10. The offshore drilling vessel is a floating structure which carries a derrick, drawworks and related drilling facilities 42. Further, the term "offshore drilling vessel" is intended to cover any transportable, floating facilities capable of supporting well operations such as drilling, completion, workover, well repair or abandonment. Preferably these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 4 is maneuverable by either catenary mooring lines 52 or dynamic positioning thrusters 54. For purposes of this embodiment, the catenary mooring lines are deployed and anchored in a spread about the semisubmersible vessel which overlaps the position of the TLWJ. Semisubmersible vessel 40A can then be maneuvered with respect to TLWJ 10 by playing out and retrieving selected catenary mooring lines 52.

FIG. 4A illustrates adaptation of conventional semisubmersible vessels to facilitate practice of the present invention. This Figure shows the end of semisubmersible vessel 40A of FIG. 4 which will approach the TLWJ. Certain conventional semisubmersible vessel configurations can be "opened up" to provide lateral access from beneath the semisubmersible vessel by removing a horizontal brace conventionally placed between the pontoons and reinforcing the remaining structure, such as with diagonal struts 94. If desired, provisions may be undertaken to allow the horizontal brace to be selectively removed for riser transfer operations, yet provide stability in place during transport and, perhaps, during drilling operations.

Another modification of conventional semisubmersible vessels necessary to best facilitate docking with a TLWJ is installation of docking elements on restraining system 60, which in this embodiment is provided by a means 60A for docking which comprises a hinged docking frame 96 and a hinged docking strut 98.

Figure 5:
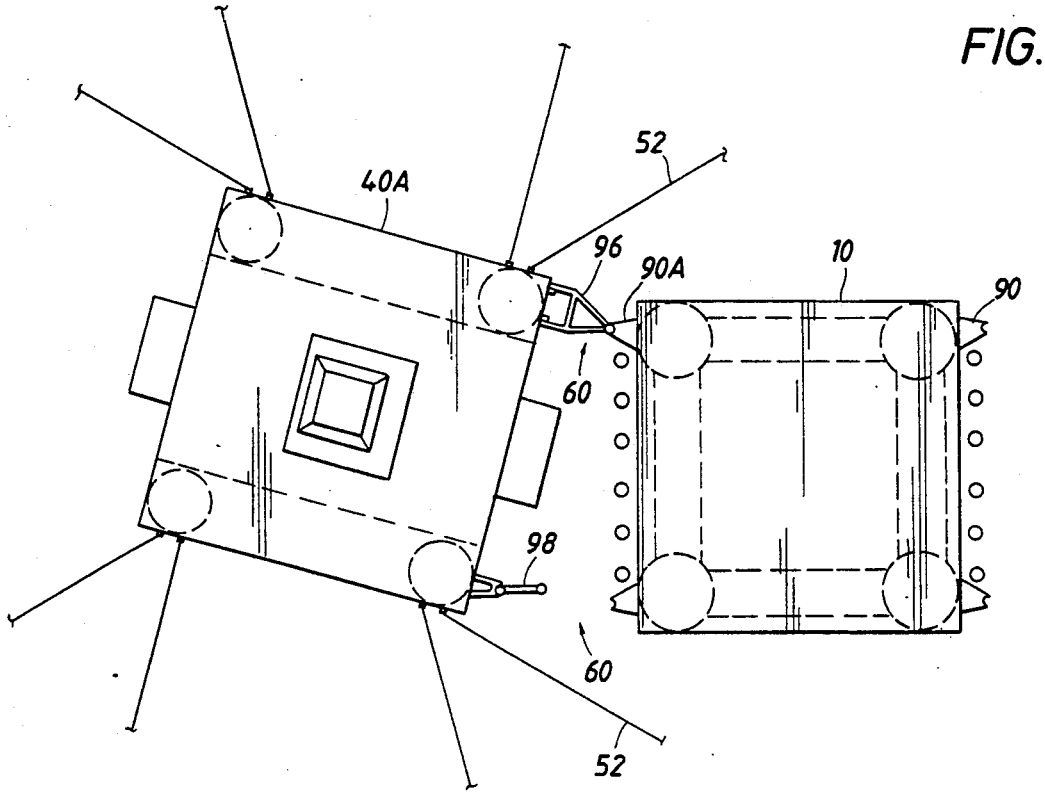
FIG. 5 is an overhead plan view of a semisubmersible vessel beginning docking operations with a TLWJ constructed in accordance with the present invention.
Figure 6:
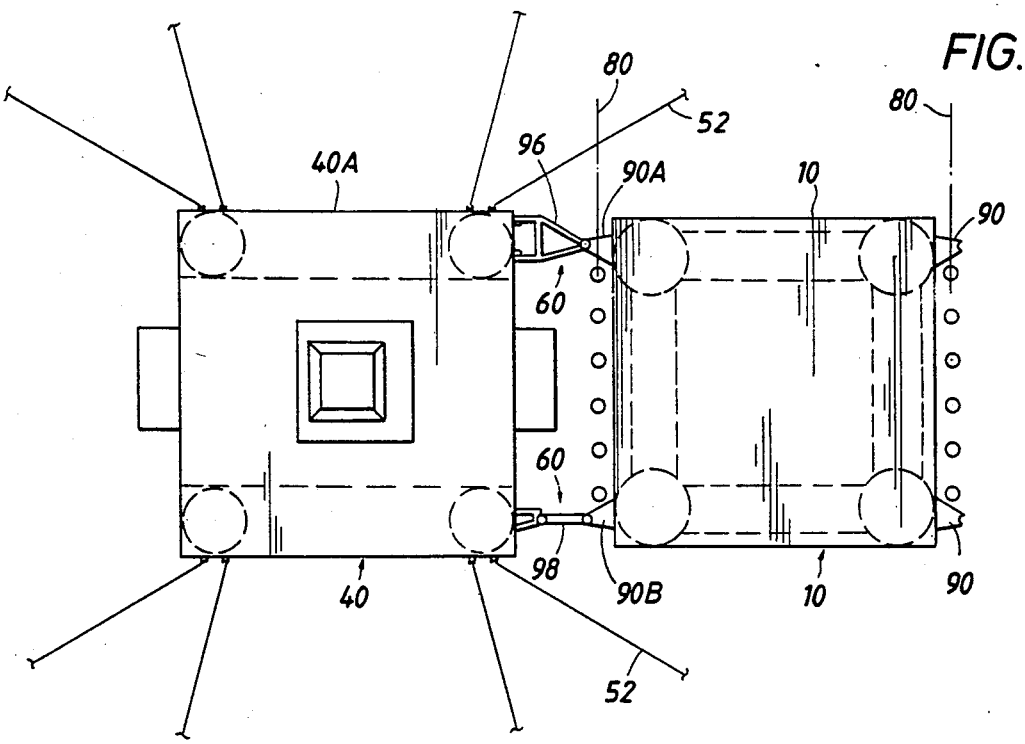
FIG. 6 is a top plan view of a semisubmersible vessel completing docking operations with a TLWJ in accordance with the present invention.

FIG. 5 illustrates the initiation of docking procedures between TLWJ 10 and semisubmersible vessel 40A. Catenary mooring lines 52 are adjusted to bring a first docking means, here lowered docking frame member 96, adjacent a second docking means, here docking support 90A, on the TLWJ and a connection is made, e.g. by inserting a pin or multi-axis rotation connection. The docking frame then secures the semisubmersible vessel to the TLWJ to produce a 2-degree of freedom restraint.

Catenary mooring lines are further adjusted to rotate the semisubmersible vessel 40A and bring lowered docking strut 98 into the position to connect with docking support 90B. See FIG. 6. Similarly, this connection can be secured with a pin or other device and will provide a 1-degree of freedom restraint. This fully secures the offshore drilling vessel 40 to TLWJ 10 such that wave action will not cause collisions between the two.

Figure 7:
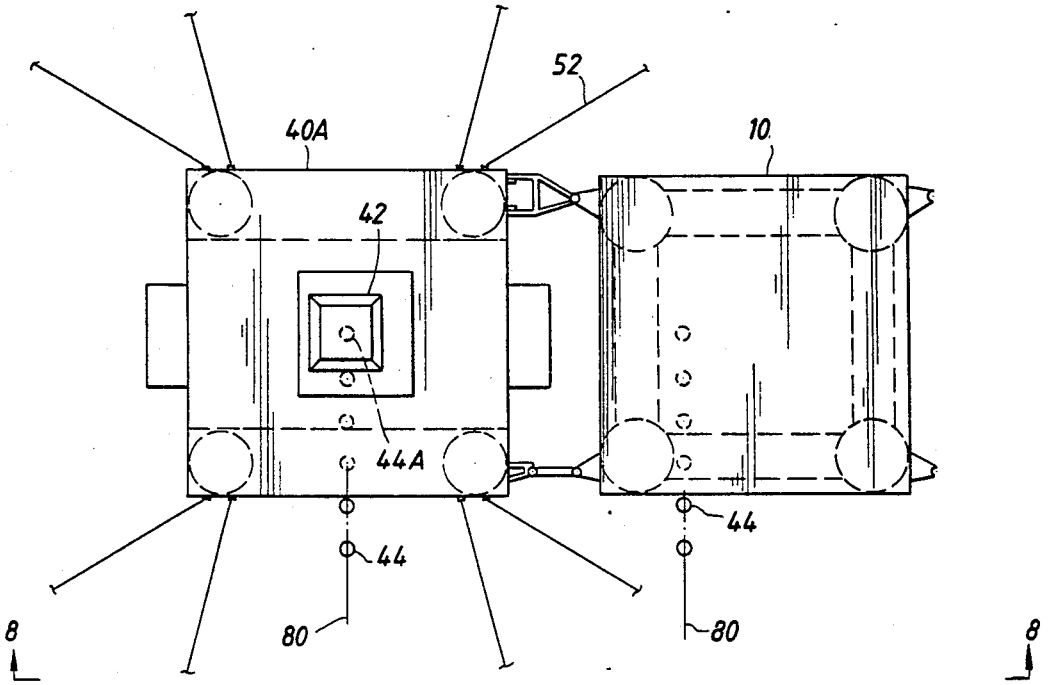
FIG. 7 is a top plan view of a semisubmersible vessel docked to a TLWJ and taking position for drilling operations.
Figure 8:
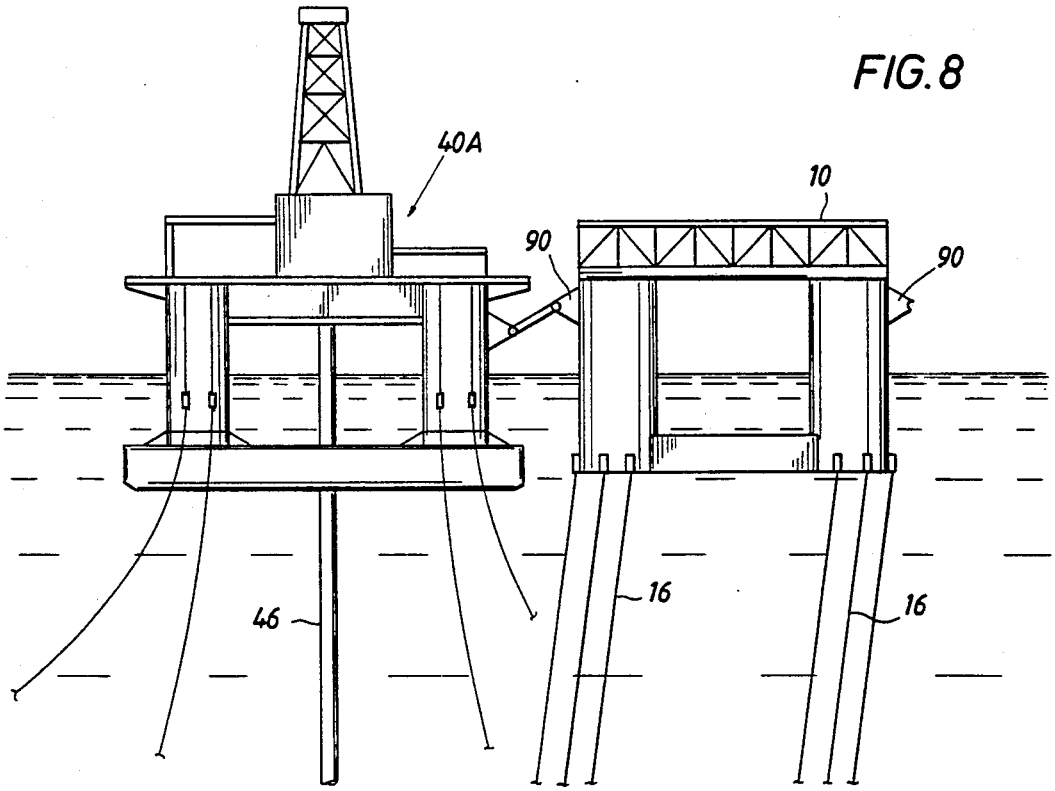
FIG. 8 is a side elevation view of a semisubmersible vessel docked with a TLWJ and conducting drilling operations.

Docking also facilitates moving TLWJ 10 with positioning systems carried on semisubmersible vessel 40A. Compare FIG. 6 in which TLWJ 10 is normally centered between well lines 80 at the periphery of the TLWJ with FIG. 7 wherein the catenary mooring lines 52 have been adjusted to bias the TLWJ out of alignment with its nominal position and to bring the derrick and related drilling facilities 42 into alignment with a selected well site 44A. The semisubmersible vessel of FIG. 7 is in position to initiate drilling or other well operations through a drilling riser 46 as further illustrated in FIG. 8. The drilling operations are best undertaken in substantially vertical drilling risers and the ability to shift TLWJ 10 slightly out of alignment with its nominal resting position in order to place the derrick over a selected well site substantially enhances drilling efficiency and reduces equipment wear. This ability also allows continuing drilling operations once the TLWJ is in place and thereby allows production to come onstream as soon as wells are completed, even as the drilling program proceeds.

Alternatively, the TLWJ may be provided with thrusters or a lateral mooring system of its own to serve as restraining system 60 in lieu of the presently preferred means 60A for docking. In this latter embodiment the restraining system of the TLWJ would pull and hold the TLWJ sufficiently clear for an offshore drilling vessel to conduct well operations adjacent the foundation of the TLWJ without danger of collision and without docking thereto.

After drilling operations are completed, drilling riser 46 is replaced with a lighter weight production riser 28 and the drilling facilities on offshore drilling vessel 40 are used through the production riser to complete the well. See FIG. 9. Alternatively, the same riser which serves as a drilling riser can serve as the production riser. After completion and installation of a surface completion or Christmas tree 30, a temporary buoyancy module 110 is installed about the production riser and the production riser is passed or transferred to TLWJ 10.

Figure 9:
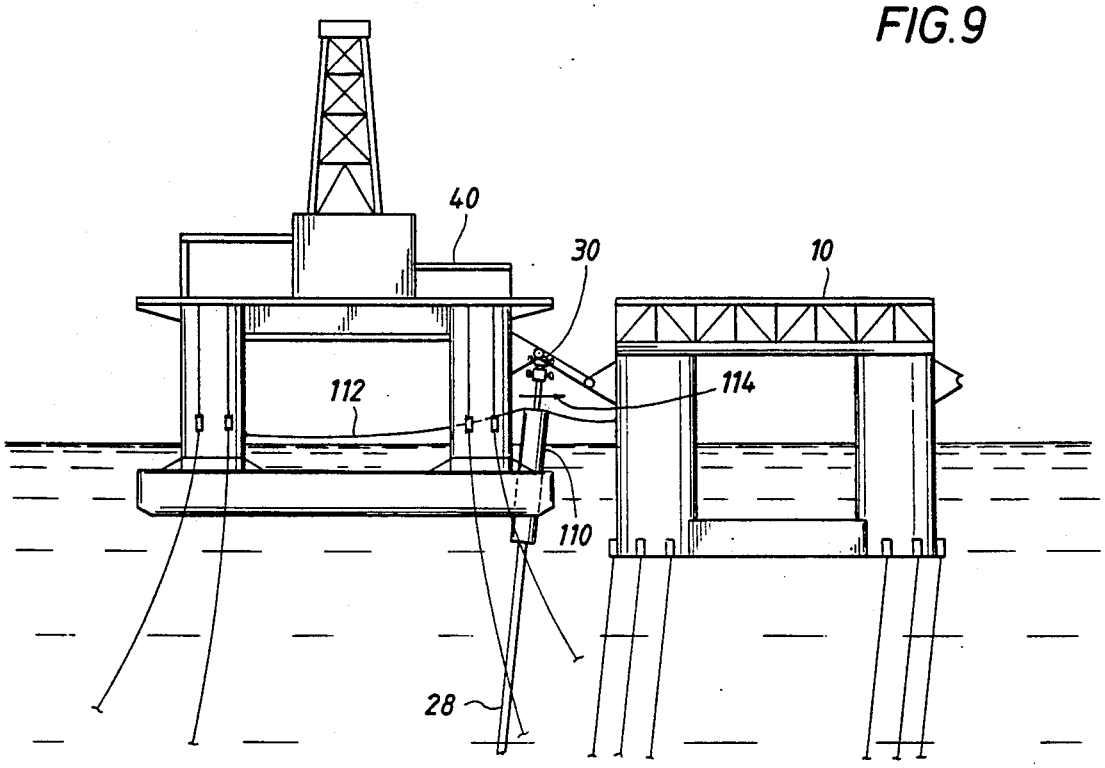
FIG. 9 is a side elevation view of a semisubmersible platform transferring a riser to a TLWJ in accordance with the present invention.
Figure 9A:
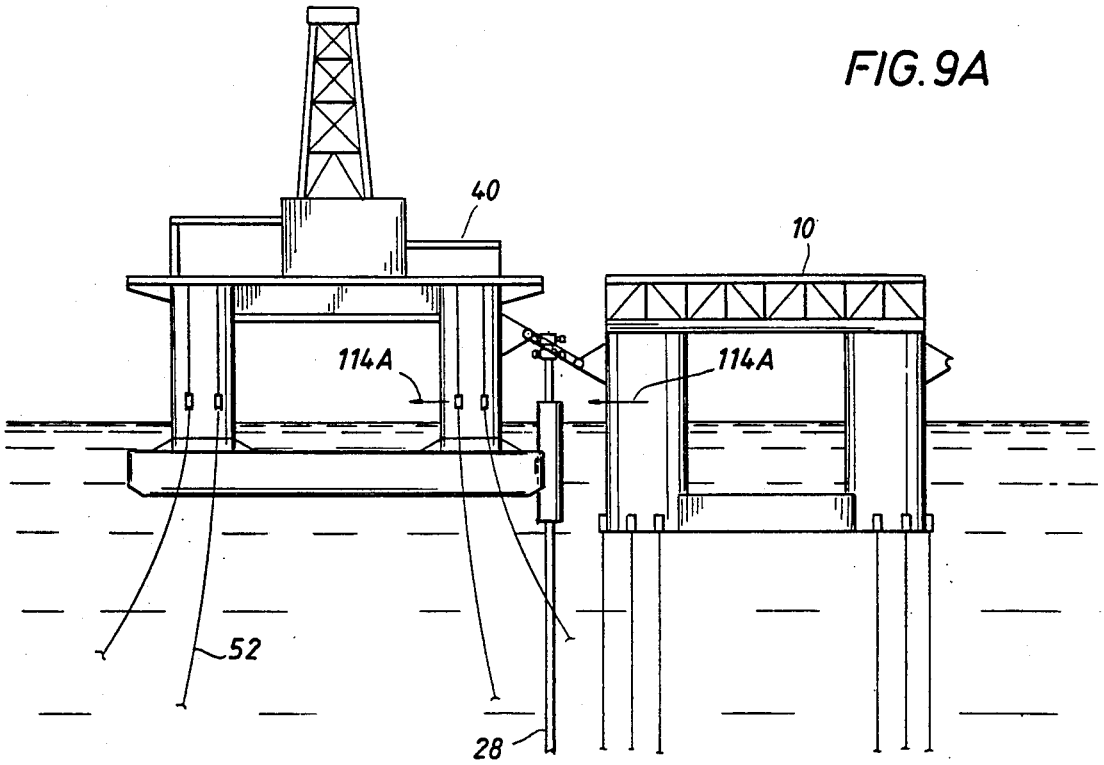
FIG. 9A is a side elevation view of an alternate embodiment of a semisubmersible vessel transferring a riser to a TLWJ in accordance with the present invention.

FIGS. 9 and 9A illustrate alternative methods for transferring the production riser. In FIG. 9, guylines 112 are used to draw production riser 28 to TLWJ 10 and arrow 114 illustrates this transfer. By contrast, FIG. 9A illustrates the use of the natural righting ability of temporary buoyancy module 110 to maintain production riser 28 in place while catenary mooring lines 52 are adjusted to bring TLWJ 10 into position to receive the substantially stationary production riser 28. Note arrows 114A. The presently preferred method for undertaking this transfer is a combination of both the embodiments of FIG. 9 and 9A.

Figure 1B:
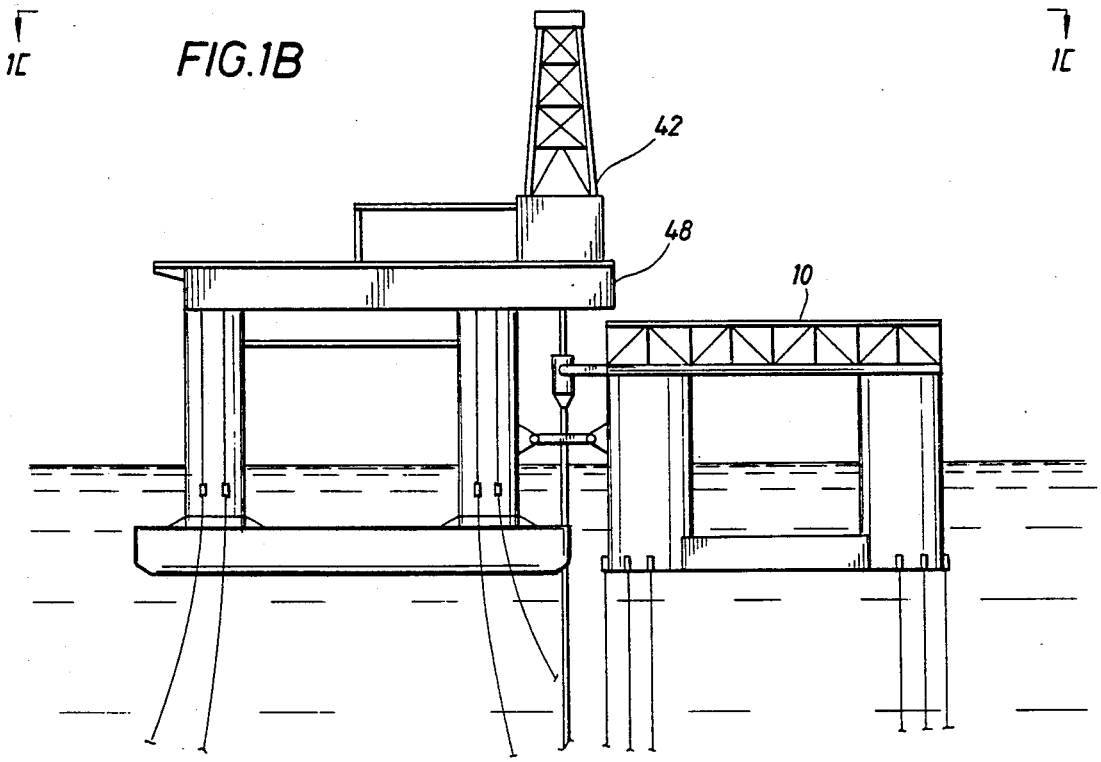
FIG. 1B is a side elevation view of an alternate embodiment of the present invention in which a semisubmersible vessel is conducting completion operations from a derrick on a cantilevered deck through risers installed on a tension leg well jacket ("TLWJ")
Figure 1C:
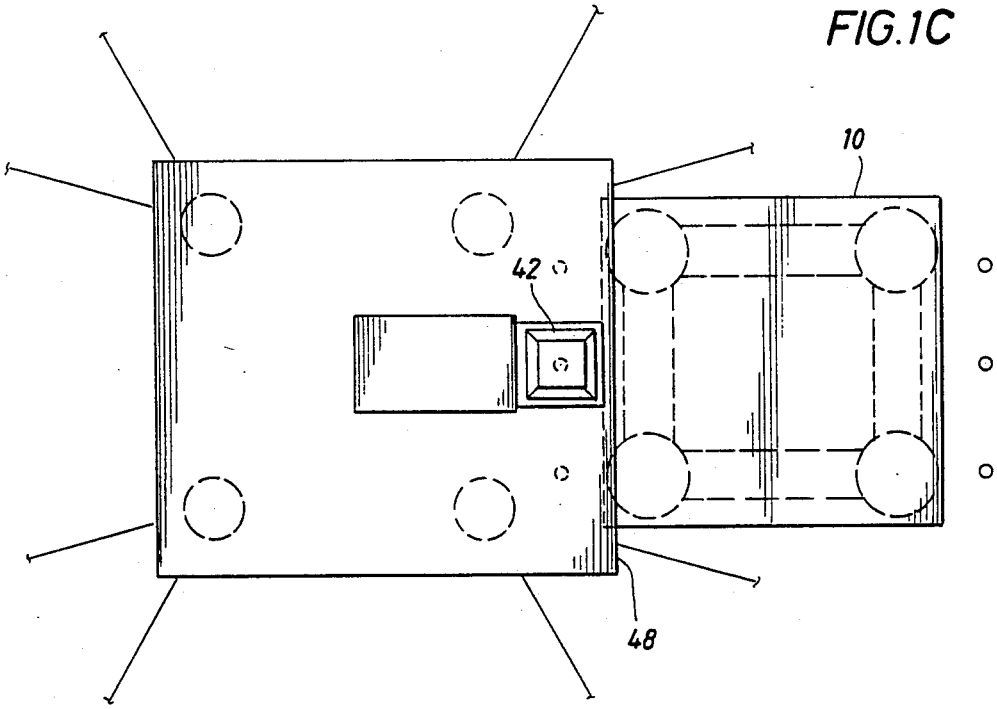
FIG. 1C is a top plan view of the semisubmersible vessel and TLWJ of FIG. 1B taken along line 1C—1C of FIG. 1B.

FIGS. 1B and 1C illustrate the use of an alternate drilling method with a TLWJ. In this method, a cantilevered end bay semisubmersible vessel is configured to bring a derrick to a position immediately adjacent the compliant platform and conduct drilling operations through a drilling riser supported by the vessel. This arrangement of a cantilevered deck 48 to allow positioning of derrick and related drilling facilities 42 permits drilling with little or no displacement of TLWJ 10. After completing the drilling operations, the drilling riser is replaced with a production riser which, preferably, is transferred to the TLWJ for completion operations with the drilling facilities of the semisubmersible vessel. FIG. 4B illustrates a special purpose semisubmersible vessel having a cantilevered deck with an end well bay providing a derrick and attendant drilling facilities thereon will allow the docking and drilling operation generally illustrated in FIGS. 1B and C.

A key aspect of the production riser transfer is the TLWJ configuration to laterally receive the production riser. FIGS. 9B, 9C and 9D show additional alternate embodiments for superstructure 12 of the TLWJ. FIGS. 9B and 9C illustrate one embodiment in which an H-shaped superstructure and a high deck permit placement of the production risers 28 underneath deck 24 in a position more sheltered than the peripheral placement in the embodiment of FIGS. 9 and 9A. FIG. 9D shows a "keyhole" deck which similarly allows laterally transferred production risers to be secured to the TLWJ at a sheltered position.

It may be desired to remove buoyancy device or module 110 from production riser 28 once the production riser has been secured to the TLWJ. Alternatively, buoyancy module 110 may be left on riser 28 to afford a measure of protection to the riser from surface hazards such as boat traffic or floating debris. This will also contribute substantially to the vertical support of the riser, thereby further reducing the required displacement of the TLWJ. See FIG. 10.

FIG. 10A illustrates the step of establishing communication between the surface completion of the production riser and the facilities on the compliant platform.

In the preferred embodiment, the transferred production riser is secured to TLWJ 10 through a dynamic tensioning device 118. See FIG. 10. The dynamic tensioning device serves to maintain a substantially constant tension on production riser 28 despite motion of compliant platform 10 due to environmental forces. Many types of dynamic tensioning devices are suitable, including pneumatic, hydraulic, elastomeric, or combinations thereof. In some instances, such as where the risers are the same length as the tendons, dynamic tensioning devices may not be necessary. The tensioning device illustrated in FIG. 10 is well suited to receiving the laterally transferred production riser and includes a lever or rocker arm 120 connected to TLWJ 10 through fulcrum 122. A pressure charged elastomeric strut 124 provides the compensating force and is connected to one end of lever arm 120 and the production riser is attached at the other end of rocker arm 120 with a pivotal load connection. In the preferred embodiment, communication is established between the surface completion or Christmas tree 30 which is affixed atop the production riser 28 with a flexible flowline 32. Flowline 32 feeds the production fluids from production riser 28 to processing facilities 26. The processing facilities may be as simple as manifolds collecting the production fluids from a number of wells and distributing them to an export riser, or may include separation equipment for removing liquid products from gas produced or other various treatment systems to initially process the produced fluids into components more suitable for transport.

Another option illustrated in FIG. 10A is the use of a tree extension 126 which can elevate flexible flowline 32 above the wave zone adjacent ocean surface 22 in the event the semisubmersible configuration requires a low mounted Christmas tree 30 for the transfer operations.

Figure 11:
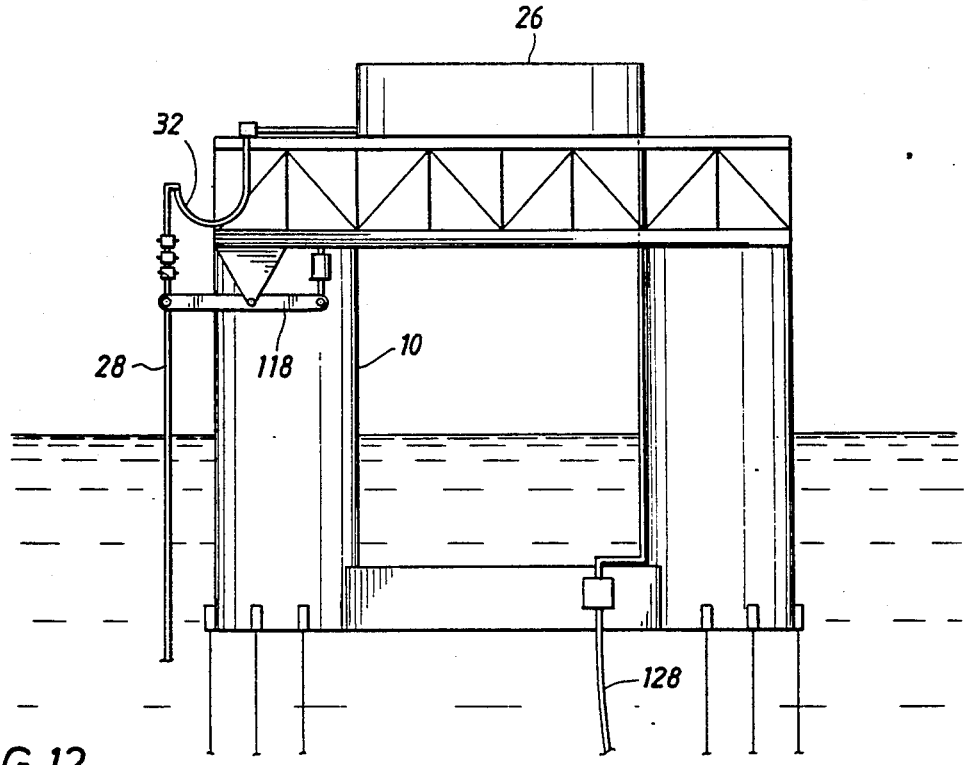
FIG. 11 is a side elevation view of a TLWJ constructed in accordance with the present invention in the production mode.

FIG. 11 illustrates TLWJ 10 in the production mode in which a plurality of production risers 28 are supported by TLWJ 10 through dynamic tensioning devices 118 and in which fluids produced from the well are carried up the production riser and to facilities 26 through flexible flowlines 32 for combination and/or treatment before export through a catenary export riser 128 to transport facilities such as a subsea pipeline (not shown).

Figure 12:
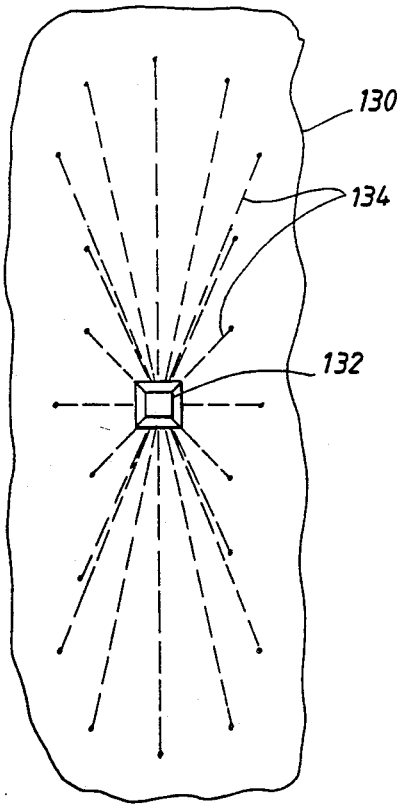
FIG. 12 (PRIOR ART)
FIG. 12 is an overhead view schematically illustrating the use in the prior art of central facilities to develop extended deepwater reservoirs.
Figure 13:
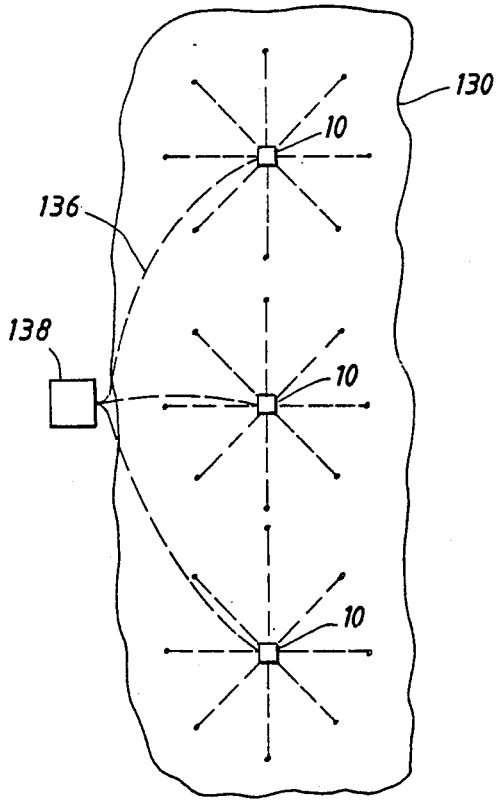
FIG. 13 is an overhead view schematically illustrating the use of satellite TLWJ's.

FIGS. 12 and 13 demonstrate some of the potential advantages of practicing the present invention. FIG. 12 is a schematic diagram of a deepwater reservoir 130 developed conventionally such as through a central TLP 132. The extended reach drilling operations from the TLP must project horizontally a great distance in order to reach the far portions of the reservoir. The completed wells are designated by broken lines 134. These wells are drilled, one well at a time, over a number of years in order to establish the pattern illustrated. Production from later wells must be deferred until they can be reached. Further, the great horizontal reach defers completion of each well while, in effect, a lengthy underground pipeline is built for each well as the wellbore is cased and drilling proceeds. The large TLP structure necessary to support the drilling operations requires a very promising field and a great number of wells to prove economically attractive and, once completed, supports an idle drilling rig substantially through the remaining life of the field.

By contrast, the same deepwater reservoir 130 is illustrated in FIG. 13 in which satellite TLWJs 10 combine with a tension leg production facility 138 to provide a more rapid, more thorough, and more economical development of reservoir 130. FIGS. 12 and 13 depict approximately the same number of total wells, at approximately the same location. However, in FIG. 13, satellite TLWJs 10 are used with less extensive extended reach drilling to efficiently collect production fluids and, with only the most minimal processing, transfer the produced hydrocarbons to processing facility 138 through pipelines 136. The TLP of production facilities 138 may itself be constructed in accordance with the present invention and deploy exteriorly receiving well bays that may support additional wells 134 drilled with external facilities. In this illustration, three separate semisubmersible vessels may simultaneously conduct drilling operations to substantially shorten the completion time. Further, this system will afford the opportunity to have revenue streams from those wells that have been completed while additional wells are being drilled. The minimal tension leg well jacket, and process facilities on a central TLP that does not have to support drilling equipment, can be installed at a lower cost than the central TLP of the prior art which accommodates drilling from the TLP. Further, after drilling is complete, the semisubmersible vessels may be put into useful service elsewhere until needed for workover operations. Thus, the present invention facilitates a development plan which reduces capital outlay, accelerates cash flow, increases the rate of return on the investment, and avoids the capital expenses associated with providing a full capability drilling rig dedicated for workover operations.

Figure 14:
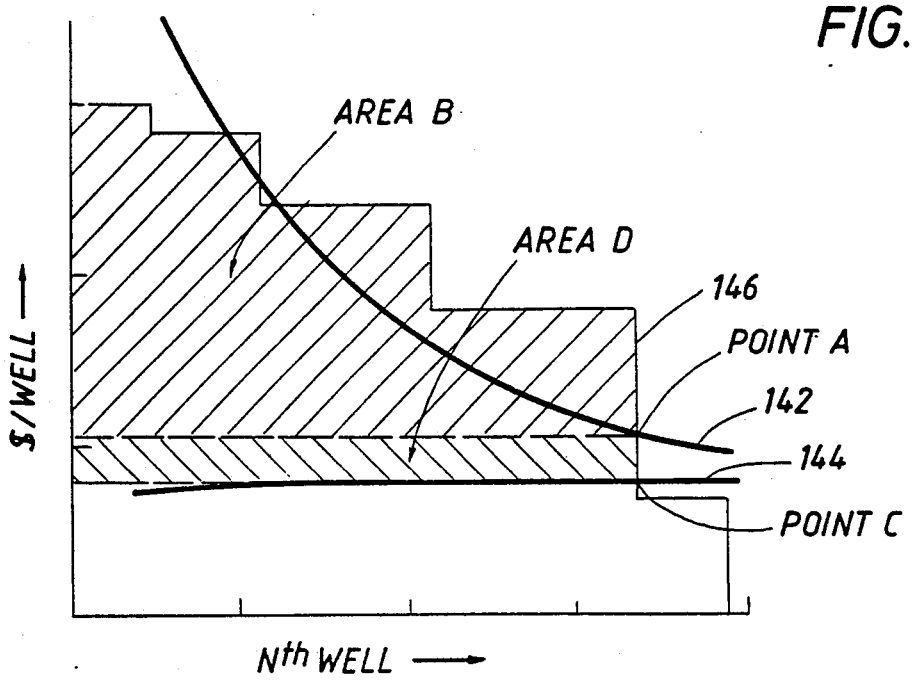
FIG. 14 is a generalized plot of economic curves of cost per well for each additional well for a hypothetical deepwater prospect "A"
Figure 15:
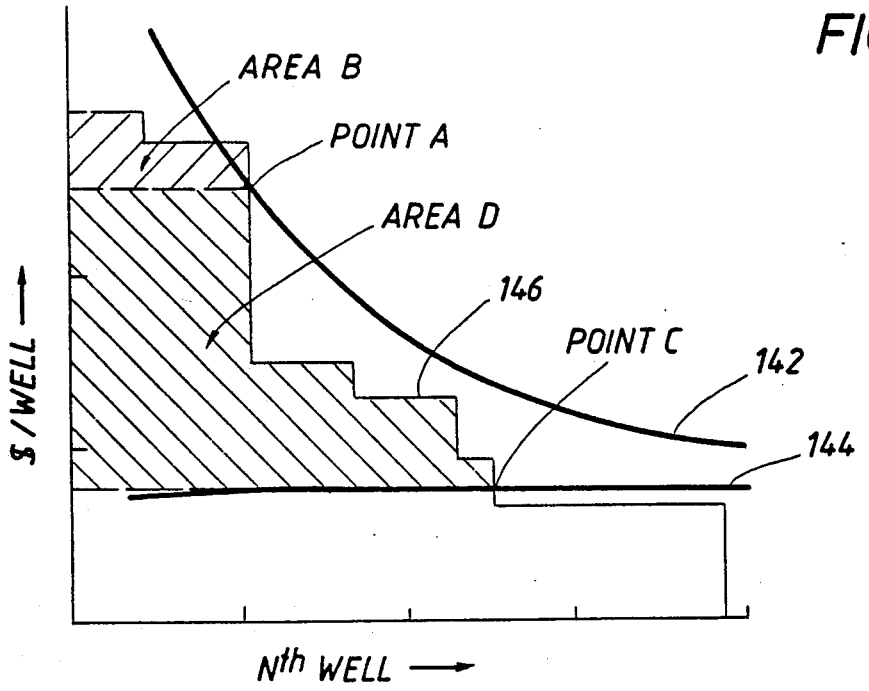
FIG. 15 is a generalized plot of economic curves of cost per well for each additional well for another hypothetical deepwater prospect, prospect "B".

FIGS. 14 and 15 further demonstrate the economic benefits afforded by the practice of the present invention. FIG. 14 is a set of generalized curves for a hypothetical prospect "A". This illustration charts average development dollars per well for a conventional TLP development which includes a dedicated drilling rig (line 142) and a TLWJ development in accordance with the present invention (line 144) versus the number of wells "n" in the development. Also plotted is the present value income for the $n^{th}$ well which is expressed as line 146.

Present value income appears as a stair step function for which incremental contribution by additional wells decreases as the number of wells approaches the reservoir's capacity. Drilling completion costs per well are notionally included in the conventional TLP and the TLWJ development cost curves, but make little impact in the comparison since they are relatively constant regardless of whether a dedicated rig is provided on the TLP in accordance with the prior art or a semisubmersible vessel is used in the practice of the present invention.

Prospect A is a very promising prospect which can support a major, conventional, TLP deployment. The incremental development cost of the conventional TLP deployment, that is line 142, intersects the line defining the present value income per well (line 146), at point A which produces a net present value profit designated by area B. Stated otherwise, the profit is the total income for all developed wells minus the total development cost which is the cost per well at the point of intersection times the number of developed wells.

By constrast, the incremental development cost of a TLWJ in the practice of the present invention intersects the present value income per well line 146 at point C and provides additional income opportunity indicated by area D, for a total present value income per well of B plus D.

While FIG. 14 does illustrate a definite advantage, the practice with less promising prospects such as prospect "B" illustrated in FIG. 15, illustrates more profound benefits available through the practice of the present invention. Again, these generalized economic curves plot development costs and income potential in terms of dollars per well as a function of the next incremental development well. The incremental development costs of a major, dedicated rig TLP remain the same, as do the incremental development costs for one or more tension leg well jackets deployed in the practice of the present invention. However, the nature of the prospect has markedly affected the available present value income per well. Here, the economic development of a TLP with dedicated drilling facilities is determined by point A, which defines little profitability B. However, the incremental cost of development for additional wells in deployment of a TLWJ in the practice of the present invention, as established by point C, defines a vast incremental benefit as the present value income of area D. Note that this benefit cannot be economically exploited by a major TLP with dedicated drilling facilities. Thus, for the same prospect, the conventional technology provides a present value income B while the present invention provides a present value income of B plus D which, for marginal prospects, can be many times that otherwise available. This also demonstrates that the practice of the present invention can render economical the development of prospects which cannot be econimically developed by the prior art.

Other benefits of using multiple, dispersed, minimal TLWJs include reducing the risk of accident by separating drilling and production operations, as well as reducing the potential magnitude of an accident. Further, it is expected that using minimal TLWJs in the practice of the present invention will significantly expand the number of suitable fabrications yards that are available and reduce cost as a result of increased competition for the construction contracts.

A number of variations have been disclosed for constructing and using tension leg well jackets, each being adapted to use temporary facilities of an offshore vessel for drilling and/or completion operations and then receive production risers passed from the offshore vessel. However, other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A tension leg well jacket for installation secured to an ocean floor, projecting above an ocean surface, and supporting a riser in communication with a well; said tension leg well jacket being adapted to receive support for well operations from an offshore drilling vessel, comprising:

a foundation secured to the ocean floor;

at least one elongated tendon attached at one end to the foundation;

a superstructure comprising a buoyant hull;

means for attaching the top of the tendon to the superstructure which is restrained thereby to float below its free-floating draft; and a laterally accessible riser support mounted on the superstructure which is separate from the means for attaching the top of the tendon to the superstructure.

2. A tension leg well jacket for installation secured to an ocean floor in the immediate vicinity of a well and projecting above an ocean surface, said tension leg well jacket being adapted to receive support for conducting well operations from an offshore drilling vessel and comprising:

a foundation secured to the ocean floor;

at least one elongated tendon attached at one end to the foundation;

a superstructure comprising a buoyant hull attached to the top of the tendon and restrained thereby to float below its free-floating draft;

at least one docking element carried on the superstructure for receiving the offshore drilling vessel form which well operations are to be conducted adjacent the tension leg well jacket;

an elongated production riser in communication with the well at its base and extending upwardly to the superstructure; and a laterally accessible riser support mounted on the superstructure adapted to receive the production riser.

3. A tension leg well jacket in accordance with claim 2 wherein the superstructure comprises a single column monopod.

4. A tension leg well jacket in accordance with claim 3 wherein the docking element is a plurality of guylines between the offshore drilling vessel and the tension leg well jacket which secures the monopod in an open area beneath the deck of the offshore drilling vessel in a fixed position therewith.

5. A tension leg well jacket in accordance with claim 3 wherein the laterally accessible riser support is a peripherally mounted riser tensioning device.

6. A tension leg well jacket in accordance with claim 3 wherein a plurality of the laterally accessible riser supports are supported by the superstructure and further comprising:

a plurality of the production risers, each extending from the ocean floor to above the ocean surface and each secured to one of the riser supports;

a Christmas tree installed on top of each production riser above the ocean surface;

a production facility supported by the superstructure;

a plurality of flowlines, each connecting the Christmas trees to the production facilities; and an export riser connected to the production facility.

7. A tension leg well jacket in accordance with claim 2 wherein the buoyant hull further comprises:

a plurality of buoyant columns;

a plurality of buoyant pontoons connecting the columns; and wherein the superstructure further comprises:

a framework further connecting the buoyant columns; and a deck supported by the framework above the ocean surface.

8. A tension leg well jacket in accordance with claim 7 wherein a plurality of the laterally accessible riser supports are peripherally mounted to the superstructure above the ocean surface.

9. A tension leg well jacket in accordance with claim 8 wherein the riser supports are dynamic riser tensioning devices.

10. A tension leg well jacket in accordance with claim 9 wherein the docking element is a docking support disposed to receive a docking frame carried by the offshore drilling vessel.

11. A tension leg well jacket in accordance with claim 10 wherein the docking support is mounted to one of the columns.

12. A tension leg well jacket in accordance with claim 10 wherein a plurality of the laterally accessible riser supports are supported by the superstructure and further comprising:

a plurality of the production risers, each extending from the ocean floor to above the ocean surface and each secured to one of the riser supports;

a Christmas tree installed on each production riser above the ocean surface;

a production facility supported by the superstructure;

a plurality of flowlines, each connecting one of the Christmas trees to the production facility; and an export riser connected to the production facilities.

13. A tension leg well jacket adapted to receive support for well operations from an offshore drilling vessel in support of a plurality of wells, comprising:

a foundation secured to the ocean floor;

a plurality of elongated tendons attached at one end to the foundation;

a superstructure comprising:

a buoyant hull attached to the top of the tendon and restrained thereby to float below its free-floating draft, said hull comprising:

a plurality of buoyant columns; and a plurality of buoyant pontoons connecting the columns;

a framework further connecting the buoyant columns; and a deck supported by the framework above the surface of the ocean;

a plurality of docking supports carried on the superstructure for receiving the offshore drilling vessel form which well operations are to be conducted adjacent the tension leg well platform;

a plurality of the laterally accessible riser supports are peripherally mounted to the superstructure above the surface of the water; and a plurality of production risers, each in fluid conducting communication with one of the wells near the ocean floor and extending upward to reception within one of the riser supports.

14. A tension leg well jacket in accordance with claim 13 wherein the riser supports are dynamic riser tensioning devices.

15. A tension leg well jacket in accordance with claim 14 wherein the production risers extend upwardly above the surface of the ocean, further comprising:
a Christmas tree installed on the top of each production riser above the surface of the ocean;
a production facility supported by the superstructure;
a plurality of flowlines, each connecting one of the Christmas trees to the production facilities; and
an export riser connected to the production facilities.

16. A tension leg well jacket secured to an ocean floor adjacent a plurality of wells and being adapted to receive support for well operations from an offshore drilling vessel floating at an ocean surface, said tension leg well jacket comprising:
a foundation secured to the ocean floor;
a plurality of elongated tendons attached at one end to the foundation;
a superstructure comprising:
a buoyant hull attached to the top of the tendon and restrained thereby to float below its free-floating draft, said hull comprising:
a plurality of buoyant columns; and
a plurality of buoyant pontoons connecting the columns;
a framework further connecting the buoyant columns; and
a deck supported by the framework above the surface of the ocean;
a plurality of docking supports carried on the superstructure for receiving the offshore drilling vessel from which well operations are to be conducted adjacent the tension leg well platform;
a plurality of the laterally accessible riser supports mounted to the superstructure above the surface of the water;
a plurality of production risers, each in fluid conducting communication with one of the wells and extending from the ocean floor to above the ocean surface where the production riser is secured to one of the riser supports;
a Christmas tree installed on the top of each production riser above the ocean surface;
a production facility supported by the superstructure;
a plurality of flowlines, each connecting one of the Christmas trees to the production facilities; and
an export riser connected to the production facilities.

17. A method of providing support to an offshore riser in communication with a well, comprising:
installing a tension leg well jacket at a selected site;
providing a laterally accessible riser support on the tension leg well jacket;
docking an offshore drilling vessel to the tension leg well jacket;
assembling a riser from the offshore drilling vessel and conducting operations downhole within a well therethrough;
transferring the riser from the offshore drilling vessel to the tension leg well jacket; and
securing the riser in the riser support.

18. A method of providing support to a plurality of production risers, each in communication with a well, comprising:
installing a minimal tension leg well jacket at a selected site;
providing a plurality of laterally accessible riser supports on the tension leg well jacket;
docking an offshore drilling vessel to the tension leg well jacket for conducting well operations therefrom downhole within a well through a production riser in communication with the well;
transferring the production riser from the offshore drilling vessel to the tension leg well jacket; and
securing the riser in the riser support.

19. A method of providing support to a plurality of production risers in accordance with claim 18 further comprising actively tensioning the riser with a dynamic riser tensioning system connecting the riser support to the tension leg well jacket.

20. A method of providing support to a plurality of production risers in accordance with claim 18 further comprising completing a well through the production riser and installing a surface Christmas tree on the production riser prior to transfer to the tension leg well jacket.

21. A method of providing support to a plurality of production risers in accordance with claim 18 further comprising establishing communication between the production riser and a production facility on the tension leg well jacket.

22. A method of providing support to a plurality of production risers in accordance with claim 21 further comprising connecting an export riser to the production facility and supporting the export riser with the tension leg well jacket.

23. A method of providing support to an offshore riser in communication with a well, comprising:
installing a tension leg well jacket at a selected site;
laterally transferring the riser from an offshore drilling vessel restrained with respect to the tension leg well jacket to conduct well operations; and
securing the riser in the riser support on the tension leg well jacket.

24. A deepwater tension leg well jacket secured to an ocean floor and supported by drilling operations for a well on an offshore drilling vessel floating on an ocean surface, said tension leg well jacket comprising:
a foundation secured to the ocean floor;
at least one tendon attached at its base to the foundation;
a buoyant hull attached to the top of the tendon and restrained thereby to float at a position lower than otherwise provided by the buoyancy of the hull;
production facilities supported above the surface of the water by the hull;
docking means for receiving the offshore drilling vessel;
at least one production riser distinct from the tendon and in communication with the well;
a riser support accessible for lateral transfer of the production riser between the offshore drilling vessel and the tension leg well jacket; and
a riser tensioning system supporting the production riser once secured in the riser support.

25. A tension leg well jacket system for developing deepwater offshore hydrocarbon reservoirs beneath an ocean floor, comprising:
an offshore drilling vessel, comprising:
a movable floating structure;
drilling facilities mounted on the movable floating structure; and
first docking means carried on the offshore drilling vessel;
a production riser in communication with the well;
a tension leg well jacket comprising:
a foundation secured to the ocean floor;

at least one tendon attached at one end to the foundation, each tendon being distinct from the production riser;

a superstructure comprising a buoyant hull attached to the other end of the tendon and restrained thereby to float at a position lower than otherwise provided by the buoyancy of the hull:

production facilities supported above water by the superstructure;

a riser tensioner mounted to the superstructure;

a riser support connected to the riser tensioner and supporting the production riser; and second docking means supported by the tension leg jacket for selectively receiving the first docking means presented by the offshore drilling vessel in a secure engagement with the tension leg well jacket for conducting drilling operations and then transferring a production riser from the offshore drilling vessel to the tension leg well jacket; and a positioning system carried on the offshore drilling vessel capable of maneuvering the offshore drilling vessel with respect to the tension leg well jacket during docking operations and of maneuvering and then holding the joined offshore drilling vessel and tension leg well jacket at a position at which the drilling facilities of the offshore drilling vessel are substantially vertically over a desired well site and maintaining such position during drilling operations.

* * * * *